US006527057B2

(12) United States Patent
Fraser, III et al.

(10) Patent No.: US 6,527,057 B2
(45) Date of Patent: Mar. 4, 2003

(54) WIPER PLUG DELIVERY APPARATUS

(75) Inventors: James M. Fraser, III, Spring, TX (US); Jonathan P. Hanson, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/819,138

(22) Filed: Mar. 27, 2001

(65) Prior Publication Data

US 2002/0139529 A1 Oct. 3, 2002

(51) Int. Cl.[7] ..... E21B 33/16
(52) U.S. Cl. ..... 166/386; 166/156
(58) Field of Search ..... 166/152, 153, 166/155, 156, 291, 386, 381, 285

(56) References Cited

U.S. PATENT DOCUMENTS 3,635,288 A * 1/1972 Lebourg ..... 166/290
3,915,226 A 10/1975 Savage
4,624,312 A * 11/1986 McMullin ..... 166/155
4,671,358 A 6/1987 Lindsey, Jr. et al.
4,842,062 A 6/1989 Schneider et al.
4,842,069 A * 6/1989 Baugh et al. ..... 166/285
4,966,236 A * 10/1990 Braddick ..... 166/291
5,018,579 A * 5/1991 Braddick et al. ..... 166/291
5,036,922 A 8/1991 Braddick
5,052,488 A 10/1991 Fraser, III
5,109,925 A 5/1992 Stepp et al.
5,522,458 A 6/1996 Watson et al.
5,553,667 A 9/1996 Budde et al.
5,762,139 A 6/1998 Sullaway et al.
5,787,979 A 8/1998 Giroux et al.
5,813,457 A 9/1998 Giroux et al.
6,056,053 A 5/2000 Giroux et al.

* cited by examiner

*Primary Examiner*—Frank S. Tsay
(74) *Attorney, Agent, or Firm*—Gerald W. Spinks

(57) ABSTRACT

An apparatus and method for delivering a liner wiper plug into a well bore on a workstring with a liner pipe, releasing the wiper plug from the workstring, and giving a positive indication of release of the wiper plug. A sleeve captures a collet to a latch ring until a plug is pumped down the workstring to cause a pressure buildup, which shears a shear screw, allowing the sleeve to shift, releasing the latch ring and the wiper plug from the workstring. A rupture disk is provided in the event of jamming of the apparatus, to allow pressurization above the wiper plug, shearing a weak link in the latch ring to release the wiper plug.

21 Claims, 1 Drawing Sheet

WIPER PLUG DELIVERY APPARATUS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention is in the field of equipment used to install a liner in a well bore.

2. Background Art

It is common to install a liner pipe in a well bore, and thereafter to pump various fluids, such as cement slurry, downhole through the liner pipe. Typically, the cement slurry exits the lower end of the liner pipe and rises into the annular space between the liner pipe and the well bore or the casing. In conjunction with this type of pumping operation, it is also common to pump a wiper plug through the liner pipe behind the cement slurry, to wipe down the walls of the liner pipe and to separate the cement slurry from other fluids subsequently pumped through the liner pipe.

In performing this type of operation, it is typical to lower the wiper plug and the liner pipe on a workstring, to pump the cement slurry through the workstring and the wiper plug, and then to release the wiper plug from the workstring to be pumped further downhole through the liner pipe, behind the slurry. It is desirable to be able to securely fasten the wiper plug to the workstring, to reliably release the wiper plug from the workstring, and to positively detect release of the wiper plug from the workstring. It is also desirable to latch the wiper plug to the workstring in such a way that a backup method of releasing the wiper plug is available, in the event of failure of the first method of release.

BRIEF SUMMARY OF THE INVENTION

This invention includes a method and apparatus for attaching a wiper plug to a workstring and for reliably, and detectably, releasing the wiper plug from the workstring. The wiper plug can be attached to the workstring, for example, by latching a collet onto a grooved latch ring, with the collet being captured or locked into place in a groove on the outer surface of the latch ring by a sleeve which is shifted over the collet fingers. Similarly, the collet could latch into a groove on the inner surface of a latch ring, and the collet could be locked into place by a sleeve which is shifted inside the collet fingers. The collet can be attached to the workstring and the latch ring attached to the wiper plug, or vice versa. The sleeve can be mounted to the workstring or to the wiper plug, and the sleeve can be designed to shift either longitudinally or rotationally, or a combination thereof The sleeve is held in place by a shearable device, such as a shear pin. A hydraulic cylinder is established between the sleeve and the workstring, for example, with a fluid port being provided in the workstring to pressurize the hydraulic cylinder.

With the wiper plug latched to the workstring, and with the collet locked in place by the sleeve, the workstring is lowered into a well bore to a desired location. When it is desired to release the wiper plug, a pumpable plug is pumped downhole through the workstring to land in, and latch to, the wiper plug, below the fluid port. This increases pressure in the hydraulic cylinder to a predetermined level, detectable at the well site, at which the shear pin shears, releasing the sleeve to be shifted away from the collet by the hydraulic cylinder. This shifting of the sleeve releases the collet to flex, allowing the latch ring to pull free from the collet, thereby disengaging the wiper plug from the workstring, assisted by hydraulic pressure against the pumpable plug, which bears downwardly on the wiper plug. The wiper plug and the pumpable plug then continue downhole. Release of the wiper plug results in a sharp drop in the fluid pressure detected at the well site, giving a positive indication that the wiper plug has been released.

In the event that the sleeve jams, or the latch ring becomes jammed in the collet, preventing the release of the wiper plug as described above, a continued increase in pressure will be detected at the well site. When the pressure reaches a second, higher, level, a rupture disk ruptures, establishing flow from the interior of the workstring to the annular space around the workstring, thereby applying hydraulic pressure directly to the outer portion of the upstream end of the wiper plug. The exertion of hydraulic pressure against this increased surface of the wiper plug can then shear a shearable device on the collet or the latch ring, such as a shearable link, to release the wiper plug from the workstring. This release can then be detected at the well site, as a sharp drop in workstring pressure.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
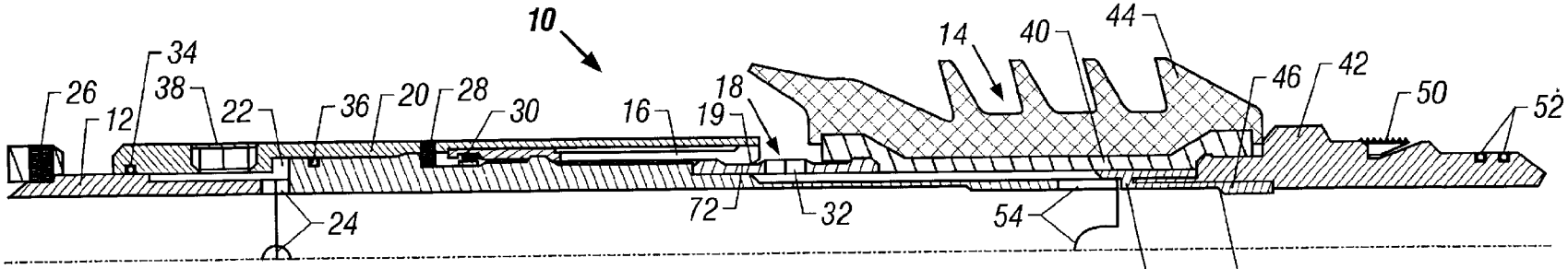
FIG. 1 is a longitudinal section view of the apparatus according to the present invention, in the run-in configuration.

As shown in FIG. 1, the apparatus 10 of the present invention includes a mandrel 12, a wiper plug 14, a collet 16, a latch ring 18, and a locking sleeve 20. The mandrel 12 is a hollow tubular structural body which can be, or can be considered to be, the lower end of the workstring. It has a central fluid passageway therethrough. An annular hydraulic cylinder 22 is formed between the mandrel 12 and the locking sleeve 20. A plurality of fluid ports 24 through the wall of the workstring or mandrel 12 connects the central fluid passageway of the mandrel 12 to the hydraulic cylinder 22. A rupture disk 38 is provided in the wall of the locking sleeve 20, between the hydraulic cylinder 22 and the annular space surrounding the tool 10. A stop ring 26 is affixed to the outer surface of the mandrel 12, above the sleeve 20, by a stop ring set screw.

In the run-in configuration of the tool 10, a shear screw 28 fixes the locking sleeve 20 longitudinally in place on the outer surface of the mandrel 12. Two seals 34, 36 seal between the inner surface of the locking sleeve 20 and the outer surface of the mandrel 12, with the lower end of the sleeve 20 extending over the downwardly extending fingers of the collet 16. The collet 16 is threaded onto the mandrel 12. A collet set screw 30 fixes the collet 16 in place on the mandrel 12. The fingers of the collet 16 fit over the upper end of the annular latch ring 18, and snap into a groove 19 on the outer surface of the upper end of the annular latch ring 18. A weak link 72 in the latch ring 18 is provided, such as by an inner annular groove at or below the engagement between the collet 16 and the latch ring 18. Since the sleeve 20 captures the fingers of the collet 16 in the groove 19, the latch ring 18 is securely latched to the mandrel 12 via the collet 16. The lower end of the latch ring 18 is threaded to the rigid cylindrical body 40 of the liner wiper plug 14. This secures the liner wiper plug 14 to the mandrel 12, via the latch ring 18 and the collet 16.

A rigid open ended annular nose 42 is threaded to the lower end of the wiper plug body 40, and a flexible elastomeric wiper 44 is formed on the annular outer surface of the wiper plug body 40. The flexible annular exterior vanes on the wiper 44 flex to seal against the liner pipe (not shown) as the liner wiper plug 14 is lowered into the well bore with the liner pipe, on the workstring. A ceramic insert 46 and a ceramic retainer ring 48 are mounted in the inner bore of the liner wiper plug 14, at the juncture of the wiper plug body 40 and the wiper plug nose 42. An angled annular seat 56 is provided in the inner bore of the ceramic insert 46. A set of exterior slips 50 and exterior annular seals 52 can be provided on the outer surface of the wiper plug nose 42.

As the tool 10 is run into the well on the workstring, the tool 10 is sometimes pulled upwardly a short distance to facilitate installation of the liner pipe (not shown). This can create excessive fluid pressure above the wiper plug 14, which seals against the liner pipe, if the fluid in this space remains trapped. At least one bypass port 32 is provided in the latch ring 18, and a plurality of bypass notches 54 are provided in the lower end of the mandrel 12. These bypass features allow fluid trapped above the wiper plug 14 to bypass the wiper plug 14 in the run-in configuration, to prevent this overpressurization.

Figure 2:
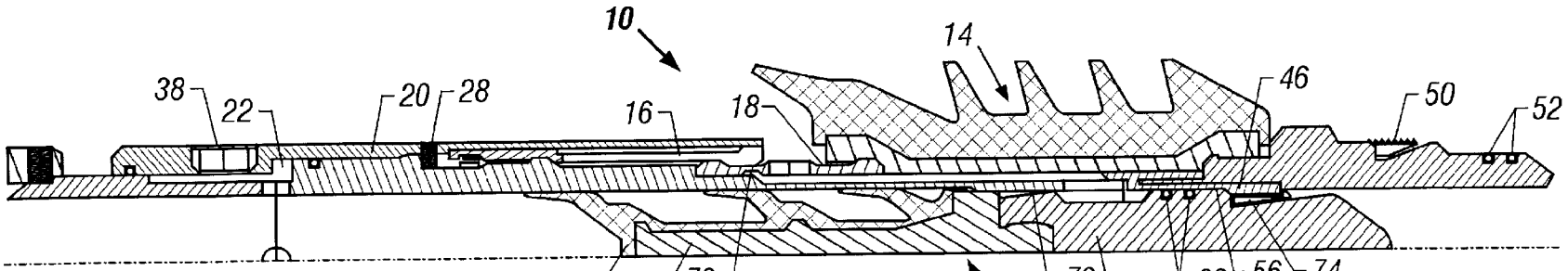
FIG. 2 is a longitudinal section view of the apparatus shown in FIG. 1, after landing of the pumpable plug in the wiper plug.

The tool 10, configured as shown in FIG. 1, is run into the casing (not shown) along with the liner pipe (not shown), to position the wiper plug 14 at the desired location for discharge of cement slurry. After discharge of the desired amount of cement slurry into and through the liner pipe (not shown), it is necessary to release the wiper plug 14 to wipe down the walls of the liner pipe. FIG. 2 shows the tool 10 after a pumpable plug 60 has been pumped downhole through the workstring to land in the nose 42 of the wiper plug 14. The pumpable plug 60 has a solid nose 62, and a body 64. A flexible elastomeric wiper 66 is formed on the annular outer surface of the pumpable plug body 64. The flexible annular exterior vanes on the wiper 66 flex to seal against the workstring and mandrel 12, as the pumpable plug 60 is pumped downhole through the workstring. The pumpable plug 60 lands in the annular seat 56 in the inner bore of the wiper plug 14. A plurality of seals 68 seal the pumpable plug 60 against the inner bore of the wiper plug 14, below the bypass notches 54, and a seal 70 seals the pumpable plug 60 against the inner bore of the mandrel 12, above the bypass notches 54. This stops the fluid flow out the bore of the wiper plug 14, causing hydraulic pressure to build up above the pumpable plug 60. A latch 74 can latch the pumpable plug 60 into engagement with the wiper plug 14.

Figure 3:
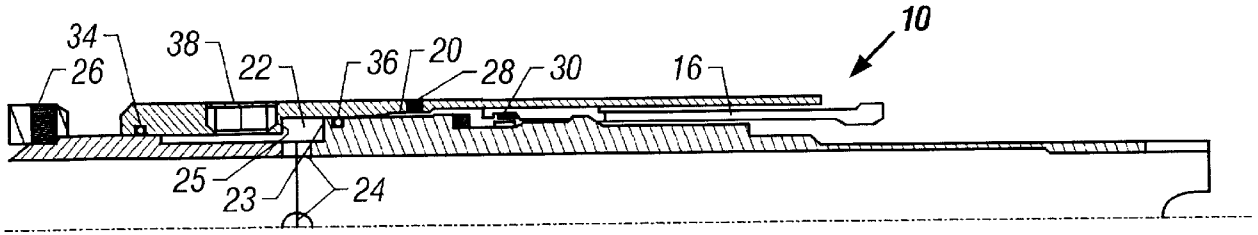
FIG. 3 is a longitudinal section view of the apparatus shown in FIG. 1, after shifting of the sleeve and release of the wiper plug.

As hydraulic pressure builds up in the bore of the mandrel 12 against the upper end of the pumpable plug 60, the hydraulic pressure also builds up in the hydraulic cylinder 22, via the fluid ports 24. This increased fluid pressure acts against an outer annular shoulder 23 on the mandrel 12 and against an inner annular shoulder 25 in the sleeve 20, urging the sleeve 20 upwardly relative to the mandrel 12. Further, since the hydraulic pressure is exerting downward force on the pumpable plug 60, the pumpable plug 60 is bearing downwardly on the wiper plug 14, which is in turn pulling downwardly on the latch ring 18. When the hydraulic pressure in the cylinder 22 is sufficiently great, the shear screw 28 is sheared, allowing the sleeve 20 to shift upwardly relative to the mandrel 12. FIG. 3 shows the tool 10 after the locking sleeve 20 has shifted upwardly against the lock ring 26. It can be seen that the sleeve 20 has shifted upwardly a sufficient distance to uncover the lower ends of the fingers of the collet 16, allowing the collet fingers to flex outwardly to release the latch ring 18. This has released the latch ring 18, the wiper plug 14, and the pumpable plug 60 to proceed further downhole, wiping the inner surface of the liner pipe (not shown).

As the wiper plug 14 and the pumpable plug 60 leave the lower end of the mandrel 12, the pressure in the bore of the workstring drops sharply, giving the operator a positive indication that the sleeve 20 has shifted and the latch ring 18 has been released. The operator knows that the sleeve 20 has shifted, since the pressure drop occurred at the pressure at which the shear screw 28 is designed to shear.

In the event that the sleeve 20, the latch ring 18, or the collet 16 becomes jammed in place, the pressure in the hydraulic cylinder 22 will continue to increase until the rupture disk 38 ruptures, allowing fluid to pass through the wall of the sleeve 20 to the outer annular space above the wiper plug 14. This applies hydraulic pressure to the increased surface area of the outer portion of the wiper plug 14, greatly increasing the downward force on the wiper plug. The hydraulic pressure in the annular space builds up until the weak link 72 in the latch ring separates, thereby allowing the lower portion of the latch ring 18, the wiper plug 14, and the pumpable plug 60 to proceed further downhole, wiping the inner surface of the liner pipe (not shown). The weak link 72 can be designed to shear at or below the pressure at which the rupture disk 38 will rupture, since the outer portion of the surface area of the wiper plug 14 will not be subjected to sufficiently high pressure to sever the weak link 72 until the rupture disk 38 ruptures. When the weak link 72 separates, the upper edge of the latch ring 18 above the weak link 72 will remain trapped by the collet 16. Here as before, as the wiper plug 14 and the pumpable plug 60 leave the lower end of the mandrel 12, the pressure in the bore of the workstring drops sharply, giving the operator a positive indication that the latch ring 18 has separated, and the wiper plug has been released. The operator knows that the latch ring 18 has separated, rather than shifting the sleeve 20, since the pressure drop occurred at the pressure at which the rupture disk 38 is designed to rupture, which is greater than the pressure at which the shear screw 28 is designed to shear.

Without departing from the spirit of the invention, the latch ring 18 could be attached to the mandrel 12 and the collet 16 could be mounted on the wiper plug 14. Similarly, the sleeve 20 could be mounted to the wiper plug 14 in the run-in configuration, rather than to the mandrel 12. Further, the sleeve 20 could be designed to shift downwardly, rather than upwardly, to release the fingers of the collet 16 from the latch ring 18. Still further, the sleeve 20 could be designed to rotate, rather than shifting longitudinally, to position slots over the fingers of the collet 16, thereby releasing the collet 16 from the latch ring 18.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A wiper plug delivery apparatus, comprising:

a hollow tubular workstring adapted to be lowered into a well bore;

a wiper plug positioned on said workstring;

a fluid path through said workstring and said wiper plug;

a releasable latching device adapted to connect said wiper plug to said workstring;

a locking device having a first position in which said locking device locks said latching device in place to latch said wiper plug to said workstring, said locking device having a second position in which said latching device is free to disengage said wiper plug from said workstring;

a hydraulic cylinder adapted to move said locking device, when said hydraulic cylinder is pressurized to a selected pressure, from said first position to said second position;

a fluid port connecting said fluid path to said hydraulic cylinder; and a pumpable plug adapted to be pumped through said workstring to plug said fluid path below said fluid port.

2. The wiper plug delivery apparatus recited in claim 1, wherein said latching device comprises:

a collet mounted to one of said workstring and said wiper plug; and a latch ring mounted to the other of said workstring and said wiper plug.

3. The wiper plug delivery apparatus recited in claim 1, wherein said locking device comprises a movable sleeve.

4. The wiper plug delivery apparatus recited in claim 1, further comprising a shearable device fixing said locking device in said first position, said shearable device being designed to shear at said selected pressure in said hydraulic cylinder.

5. The wiper plug delivery apparatus recited in claim 1, wherein said hydraulic cylinder is formed between said locking device and said workstring, said hydraulic cylinder being adapted to move said locking device relative to said workstring.

6. The wiper plug delivery apparatus recited in claim 1, wherein said hydraulic cylinder is adapted to move said locking device longitudinally.

7. The wiper plug delivery apparatus recited in claim 1, wherein said pumpable plug is adapted to plug said fluid path within said wiper plug.

8. The wiper plug delivery apparatus recited in claim 1, further comprising a bypass flow device selectively operable to establish fluid flow from said fluid path to the exterior of said workstring, at a second selected pressure higher than said first selected pressure.

9. The wiper plug delivery apparatus recited in claim 8, wherein said bypass flow device comprises a rupture disk.

10. A wiper plug delivery apparatus, comprising:

a hollow tubular workstring adapted to be lowered into a well bore;

a wiper plug positioned adjacent a lower end of said workstring;

a fluid path through said workstring and said wiper plug;

a collet mounted to one of said workstring and said wiper plug;

a latch ring mounted to the other of said workstring and said wiper plug;

a movable sleeve having a first position in which said sleeve engages said collet with said latch ring to latch said wiper plug to said workstring, said sleeve having a second position in which said collet is free to disengage from said latch ring;

a hydraulic cylinder formed between said sleeve and said workstring, said hydraulic cylinder being adapted to move said sleeve relative to said workstring, when said hydraulic cylinder is pressurized to a first selected pressure, from said first position to said second position;

a fluid port connecting said fluid path to said hydraulic cylinder;

a pumpable plug adapted to be pumped through said workstring to plug said fluid path below said fluid port; and a bypass flow device selectively operable to establish fluid flow from said fluid path to the exterior of said workstring, at a second selected pressure higher than said first selected pressure.

11. The wiper plug delivery apparatus recited in claim 10, further comprising a shearable device fixing said sleeve in said first position, said shearable device being designed to shear at said first selected pressure in said hydraulic cylinder.

12. The wiper plug delivery apparatus recited in claim 11, wherein said shearable device comprises a shear pin.

13. The wiper plug delivery apparatus recited in claim 10, wherein said hydraulic cylinder includes an external shoulder on said workstring and an internal shoulder on said sleeve.

14. The wiper plug delivery apparatus recited in claim 10, wherein said pumpable plug is adapted to plug said fluid path within said wiper plug.

15. The wiper plug delivery apparatus recited in claim 10, further comprising a shearable device on one of said collet and said latch ring.

16. The wiper plug delivery apparatus recited in claim 10, wherein said bypass flow device comprises a rupture disk in said sleeve.

17. A method for delivering a wiper plug, comprising:

latching a wiper plug to a workstring with a latching device;

locking said latching device in place with a locking device;

lowering said wiper plug into a well bore;

pumping a fluid through said workstring and through said wiper plug;

pumping a plug through said workstring to re-route fluid flow to a downhole hydraulic cylinder;

shifting said locking device with said hydraulic cylinder, at a first selected pressure, to unlock said latching device; and disengaging said wiper plug from said workstring.

18. The method recited in claim 17, wherein:

said latching device comprises a latch ring on one of said wiper plug and said workstring, and a collet on the other of said wiper plug and said workstring;

said latching of said wiper plug to said workstring comprises engagement of said latch ring with said collet; and said disengagement of said wiper plug from said workstring comprises disengagement of said latch ring from said collet.

19. The method recited in claim 18, wherein:

said locking device comprises a sleeve;

said locking of said latching device in place comprises shifting said sleeve in a first direction to capture said collet to said latch ring; and said unlocking of said latching device comprises shifting said sleeve in a second direction to allow said latch ring to disengage from said collet.

20. The method recited in claim 19, wherein said shifting of said sleeve in said second direction comprises: shearing a shearable device to release said sleeve from said workstring; and shifting said sleeve relative to said workstring.

21. The method recited in claim 17, further comprising:

detecting a pressure in said workstring higher than said first selected pressure;

increasing said pressure in said workstring to a second selected pressure higher than said first selected pressure to establish flow through a bypass flow device from the interior to the exterior of said workstring, thereby applying pressure to said wiper plug; and shearing a shearable device to release said wiper plug from said workstring.

* * * * *